US011855381B2

(12) United States Patent
Yow et al.

(10) Patent No.: US 11,855,381 B2
(45) Date of Patent: Dec. 26, 2023

(54) CHASSIS HAVING AN INSERTION KEY ASSEMBLY FOR A PLUGGABLE MODULE

(71) Applicant: HEWLETT PACKARD ENTERPRISE DEVELOPMENT LP, Houston, TX (US)

(72) Inventors: See Yun Yow, Singapore (SG); Tatt Hoong Chow, Singapore (SG); Foo Luen Wong, Singapore (SG); Mun Hoong Tai, Singapore (SG)

(73) Assignee: Hewlett Packard Enterprise Development LP, Spring, TX (US)

( * ) Notice: Subject to any disclaimer, the term of this patent is extended or adjusted under 35 U.S.C. 154(b) by 66 days.

(21) Appl. No.: 17/673,233

(22) Filed: Feb. 16, 2022

(65) Prior Publication Data

US 2023/0261410 A1 Aug. 17, 2023

(51) Int. Cl.
*H01R 13/453* (2006.01)

(52) U.S. Cl.
CPC ..... *H01R 13/4534* (2013.01)

(58) Field of Classification Search
CPC ..... H01R 13/4534; H01R 13/453; H01R 13/4532; H01R 13/4538; H01R 13/447
USPC ..... 439/137, 630, 631, 636, 639, 640
See application file for complete search history.

(56) References Cited

U.S. PATENT DOCUMENTS 4,379,607 A 4/1983 Bowden, Jr.
4,544,219 A 10/1985 Barkas
4,721,197 A * 1/1988 Hoffman ..... G07F 11/14 221/92
5,337,876 A * 8/1994 McGee ..... G07F 11/42 221/75
5,664,950 A * 9/1997 Lawrence ..... H01R 31/06 70/58
5,734,558 A * 3/1998 Poplawski ..... G02B 6/4277 361/752
6,247,610 B1 * 6/2001 Ziesel ..... G07F 9/02 221/121
6,517,382 B2 * 2/2003 Flickinger ..... H05K 9/0058 439/607.23
6,741,463 B1 * 5/2004 Akhtar ..... H05K 7/1421 361/679.41
6,816,376 B2 * 11/2004 Bright ..... H05K 7/20418 165/185

(Continued)

*Primary Examiner* — Harshad C Patel
(74) *Attorney, Agent, or Firm* — Hewlett Packard Enterprise Patent Department

(57) ABSTRACT

Example implementations relate to an insertion key assembly for a pluggable module. The insertion key assembly includes a stopper element having a stopping tab, a biasing element, and a driver element having a driving tab. The biasing element is connected to the stopper element and the driver element. In a relaxed state of the biasing element: i) the stopper element is pushed outwards by the biasing element to protrude the stopping tab into a passageway defined by a plurality of walls of a chassis, to block insertion of the pluggable module inside the passageway, and ii) the driver element is pushed outwards by the biasing element to protrude the driving tab into adjacent passageway. In a biased state of the biasing element, the stopper element is pulled inwards by the biasing element to retract the stopping tab from the passageway to allow insertion of the pluggable module inside the passageway.

20 Claims, 8 Drawing Sheets

(56) References Cited

U.S. PATENT DOCUMENTS 7,077,686 B2 * 7/2006 Seo ..... G02B 6/4292 439/372
7,150,653 B1 * 12/2006 Mason ..... H01R 13/6582 439/607.18
7,230,833 B1 * 6/2007 Sickels ..... H01R 13/518 361/740
7,438,596 B2 * 10/2008 Phillips ..... H01R 13/6582 439/927
7,731,524 B2 * 6/2010 Dittus ..... H05K 7/1492 439/248
7,934,959 B2 * 5/2011 Rephaeli ..... G02B 6/4284 439/620.22
8,002,556 B2 * 8/2011 Benedetto ..... H04Q 1/142 439/61
8,272,878 B2 * 9/2012 Neumetzler ..... H01R 13/6596 439/61
8,339,784 B2 * 12/2012 Pirillis ..... H05K 7/20145 361/679.5
8,371,861 B1 * 2/2013 Cina ..... H01R 13/6461 439/62
8,449,331 B2 * 5/2013 Phillips ..... H01R 13/6581 439/607.21
9,065,187 B2 * 6/2015 Leshniak ..... H01K 5/00
10,104,760 B1 * 10/2018 Briant ..... G02B 6/4284
10,276,995 B2 * 4/2019 Little ..... G02B 6/4284
10,644,472 B2 * 5/2020 Kazav ..... H01R 4/52
11,245,230 B2 * 2/2022 Dunwoody ..... H01R 13/5219
11,303,059 B2 * 4/2022 Duan ..... H01R 13/46
2002/0149915 A1 * 10/2002 Yap ..... G06F 1/1656 361/752
2008/0266777 A1 * 10/2008 Goldstein ..... H01R 12/716 361/748
2017/0005446 A1 * 1/2017 Regnier ..... H01R 12/721
2017/0077643 A1 * 3/2017 Zbinden ..... G02B 6/4268

* cited by examiner

CHASSIS HAVING AN INSERTION KEY ASSEMBLY FOR A PLUGGABLE MODULE

BACKGROUND

A chassis of an electronic system, such as a networking system, a server system, or a storage system, may include passageways (or slots) for receiving and securing a variety of pluggable modules (or removable electronic devices) of the electronic system. The pluggable modules may include a switch device, a small form-factor removable (SFP) transceiver device, a non-volatile memory express (NVMe) storage drive, a power supply device, a fan tray, a module card, a line card, or the like. The pluggable modules may be inserted into the electronic system to perform one or more functions, such as transmitting data, receiving data, processing data, storing data, supplying power, or the like.

BRIEF DESCRIPTION OF THE DRAWINGS

Various examples will be described below with reference to the following figures.

DETAILED DESCRIPTION

Figure 1:
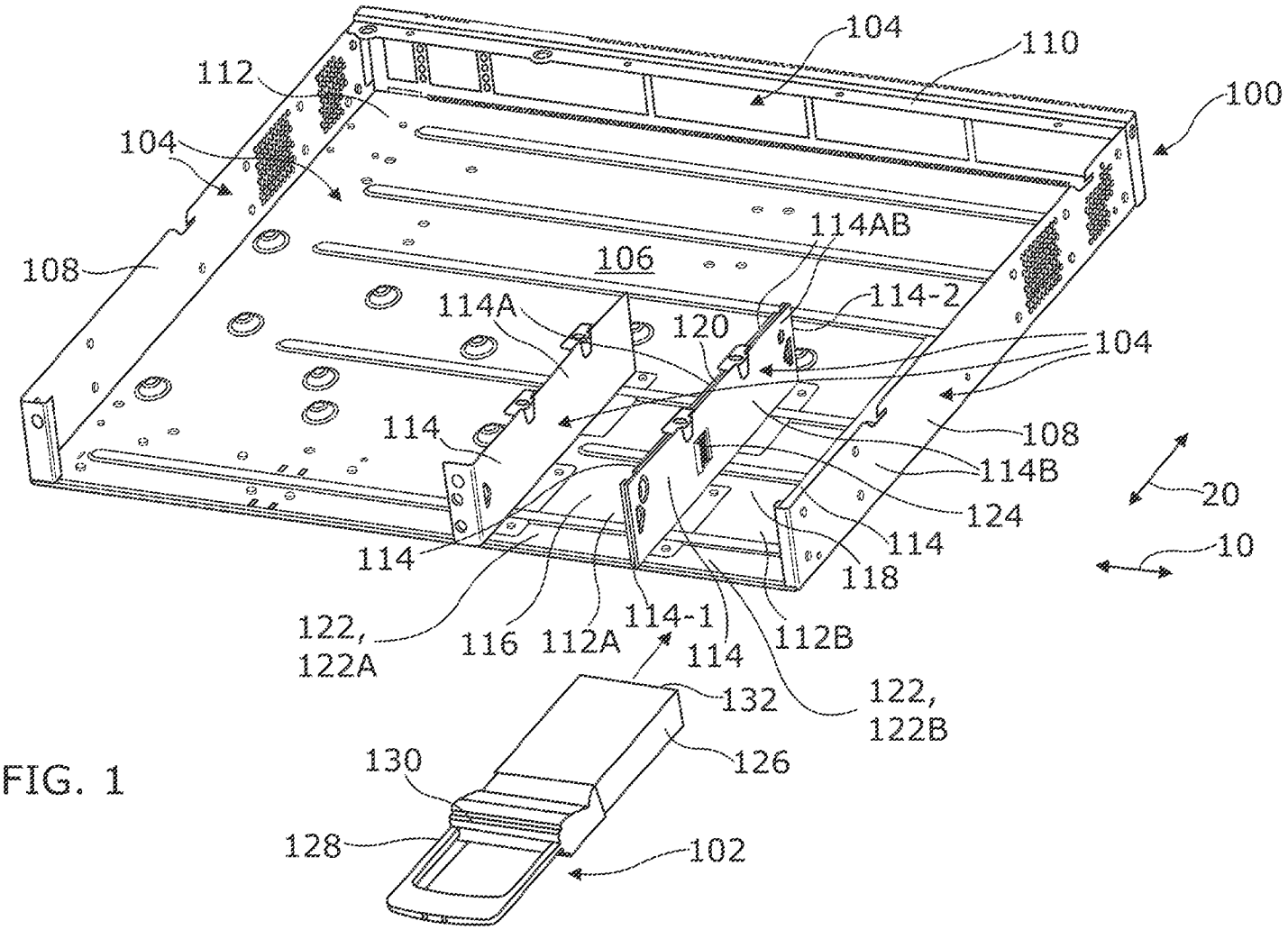
FIG. 1 illustrates an electronic system including a pluggable module and a chassis having an insertion key assembly according to an example implementation of the present disclosure.

The following detailed description refers to the accompanying drawings. Wherever possible, the same reference numbers are used in the drawings and the following description to refer to the same or similar parts. It is to be expressly understood, however, that the drawings are for the purpose of illustration and description only. While several examples are described in this document, modifications, adaptations, and other implementations are possible. Accordingly, the following detailed description does not limit the disclosed examples. Instead, the proper scope of the disclosed examples may be defined by the appended claims.

The terminology used herein is for the purpose of describing examples only and is not intended to be limiting. As used herein, the singular forms "a," "an," and "the" are intended to include the plural forms as well, unless the context clearly indicates otherwise. The term "plurality," as used herein, is defined as two, or more than two. The term "another," as used herein, is defined as at least a second or more. The term "coupled," as used herein, is defined as connected, whether directly without any intervening elements or indirectly with at least one intervening element, unless otherwise indicated. Two elements may be coupled mechanically, electrically, and/or communicatively linked through a communication channel, pathway, network, or system. The term "and/or" as used herein refers to and encompasses any and all possible combinations of one or more of the associated listed items. It will also be understood that, although the terms first, second, third, etc. may be used herein to describe various elements, these elements should not be limited by these terms, as these terms are only used to distinguish one element from another unless stated otherwise or the context indicates otherwise. As used herein, the term "includes" means includes but not limited to, the term "including" means including but not limited to. The term "based on" means based at least in part on. As used herein, the term "biasing member" may refer to a type of a flexible component, which may be compressed/rotated by applying a force, held in a compressed/rotated position, and restored to an original position from the compressed/rotated position upon release of the applied force. For example, the biasing member may be a spring, such as a torsional spring, leaf spring, or the like. As used herein, the term "electronic system" may refer to a type of a computing system, such as a server system, a storage system, a power conversion system, or a networking system, including a chassis having i) an elongated passageway to receive a pluggable module, and ii) a connector or a modular port to connect the received pluggable module to the electronic system. As used herein, the term "pluggable module" may refer to a type of removable electronic device, which is not native to the electronic system, or which is ancillary to the electronic system, and may have to be attached by way of inserting into the passageway and connecting into the modular port of the electronic system, to transmit, receive, store, process data, supply power, or the like. For example, the removable electronic device may be a pluggable transceiver device or a pluggable storage drive, or modular power supply device, or the like. The term "modular port" may refer to a type of electronic connector, which is native to the electronic system, or which is integral to the electronic system, and which may provision the pluggable module to be attached to the electronic system. Further, the term "plugging" may refer to installing the pluggable module into the passageway, and connecting to the modular port of the electronic system by way of inserting or sliding the pluggable module into the passageway (or adjacent passageway) and connecting a socket of the pluggable module to the modular port of the electronic system. As used herein the term "passageway" and "adjacent passageway" may refer to a slot and adjacent slot respectively, in a chassis of the electronic system, which may be accessible from an outside environment for installing the pluggable module into the electronic system. As used herein, the terms "pluggable module" and "another pluggable module" are used interchangeably without deviating from the scope of the present disclosure. Further, it may be noted that the pluggable module and the other pluggable are substantially similar modules.

For purposes of explanation, certain examples are described with reference to the components or elements illustrated in FIGS. 1-6. The functionality of the illustrated components or elements may overlap, however, and may be present in a fewer or greater number of elements or components. Further, all or part of the functionality of the illustrated elements may co-exist or be distributed among several geographically dispersed locations. Moreover, the disclosed examples may be implemented in various environments and are not limited to the illustrated examples. The present disclosure merely sets forth possible examples of implementations, and many variations and modifications may be made to the described examples. Such modifications and variations are intended to be included within the scope of this disclosure and protected by the following claims.

A datacenter environment includes electronic systems, such as server systems, storage systems, networking systems, or the like, to deploy one or more workloads (e.g., of one or more customers). For example, each electronic system may include a plurality of electronic devices disposed within a respective chassis for executing the one or more workloads. The plurality of electronic devices may include blade servers, storage devices, network switches, etc. Further, the chassis of some electronic systems may include multiple passageways for receiving pluggable modules and connecting the received pluggable modules to at least one electronic device disposed within the chassis. The pluggable module may include a networking device, such as a transceiver, or a storage drive, such as an NVMe storage drive, or a power supply device, or the like. Since some electronic systems provide an option for an administrator to insert/plug the pluggable modules, there may be a situation where the administrator may inadvertently install or plug certain types of pluggable modules that the chassis does not support. To handle such error events, the electronic system may include an error indicator, for example, a software-based error indicator, to raise an error flag to the administrator to rectify the error. In such scenarios, if the administrator fails to notice the error flag and does not timely rectify the error, the electronic system may be forced to undergo shutdown, performance of the pluggable module and/or the electronic system may be affected, and/or failure of the pluggable module may result.

Furthermore, the pluggable module may need to be inserted in a specific passageway among multiple passageways to efficiently receive a cooling fluid from a thermal management system of the datacenter environment, in order to cool the pluggable modules disposed within the chassis. For example, the thermal management system may be designed to provide cooling fluid to pluggable modules in sequential order. In such examples, if any of an upstream passageway (or first passageway or adjacent passageway or higher priority passageway) in the sequential order is left unoccupied, and a downstream passageway (or second passageway or passageway or lower priority passageway) in the sequential order is occupied by the pluggable device, then the cooling system may fail to: i) notice the presence of the pluggable module in the downstream passageway and ii) supply the cooling fluid to the downstream passageway for dissipating the waste-heat from the pluggable module disposed in the downstream passageway. Accordingly, the pluggable module inserted in the downstream passageway may not operate efficiently and/or a failure of the pluggable module may result.

A technical solution to the aforementioned problems may include providing a chassis having a physical insertion key assembly to control an insertion (or priority of insertion) of a pluggable module into the chassis. In one or more examples, the insertion key assembly may include a stopper element which may prevent the insertion of the pluggable module in the downstream passageway unless upstream passageways are already occupied. In particular, the stopper element may include a stopping tab, which protrudes perpendicularly into the second passageway, to function as an obstructor so as to prevent an entry (or an insertion) of the pluggable module into the second passageway. However, the stopper element may be retracted inwards (or away) from the second passageway upon insertion of another pluggable module inside the first passageway, thereby allowing the insertion of the pluggable module inside the second passageway post-insertion of the other pluggable module inside the first passageway. Accordingly, with the usage of the priority insertion key assembly in the chassis rather than (or in addition to) a software-based error indicator, erroneous or harmful physical configurations incompatible with the thermal management system may be reduced or avoided.

Accordingly, the insertion key assembly of the present disclosure may provide significant electronic system level advantages like thermal, usability and performance optimization of pluggable modules. Further, the priority insertion key having a simple design may be easy to manufacture and assemble, and may be cost-effective. Moreover, the insertion key assembly may also allow for a much more controlled field employment of the pluggable modules, and prevent inadvertent or misuse of the electronic system by the pluggable module. With the usage of the insertion key assembly in the chassis, a physical stopper element may be implemented, rather than or in addition to a software-based error indicator to control the insertion of the pluggable module, thereby preventing erroneous configurations in which the pluggable module is inserted into a lower priority passageway instead of an available higher priority passageway in the chassis.

Accordingly, the present disclosure describes example implementations of a chassis having an insertion key assembly for a pluggable module (or pluggable electronic device) of an electronic system. The insertion key assembly includes a driver element, a stopper element, and a biasing element. In one or more examples, the driver element includes a driving tab, and the stopper element includes a stopping tab. In some examples, the driver element extends from the stopper element. In such examples, the biasing element is connected to the driver element, and is disposed in contact with the stopper element. In some other examples, the driver element is connected to the stopper element via the biasing element. In some examples, in a relaxed state of the biasing element: i) the stopper element is pushed outwards by the biasing element so as to protrude the stopping tab into a passageway defined by a plurality of walls of the chassis to block an insertion of the pluggable module inside the passageway, and ii) the driver element is pushed outwards by the biasing element so as to protrude the driving tab into an adjacent passageway defined by the plurality of walls of the chassis. In the biased state of the biasing element, the stopper element is pulled inwards by the biasing element so as to retract the stopping tab from the passageway to allow the insertion of the pluggable module inside the passageway. In one or more examples, the biasing element is moved from the relaxed state to the biased state by the driver element, upon the insertion of another pluggable module inside the adjacent passageway.

Turning to the Figures, FIG. 1 depicts a perspective view of a chassis 100 and a pluggable module 102 of an electronic system, such as a networking system, a server system, a storage system, or the like. In some examples, the chassis 100 is a box-shaped enclosure formed by a plurality of walls 104 connected to each other to define an interior space 106 therebetween. In such examples, the chassis 100 may allow a plurality of electronic devices (not shown), such as blade servers, rack servers, networking devices, or the like to be disposed within at least some portion of the interior space 106 of the chassis 100 to form the electronic system. For example, the chassis 100 may include a plurality of containers or shelfs positioned within the interior space 106 to receive, house, and support the plurality of electronic devices. In one or more examples, the chassis 100 having such plurality of electronic devices may be mounted to a rack or an enclosure of a datacenter environment, where each of the plurality of electronic devices, during operation, may execute one or more workloads.

Figure 3A:
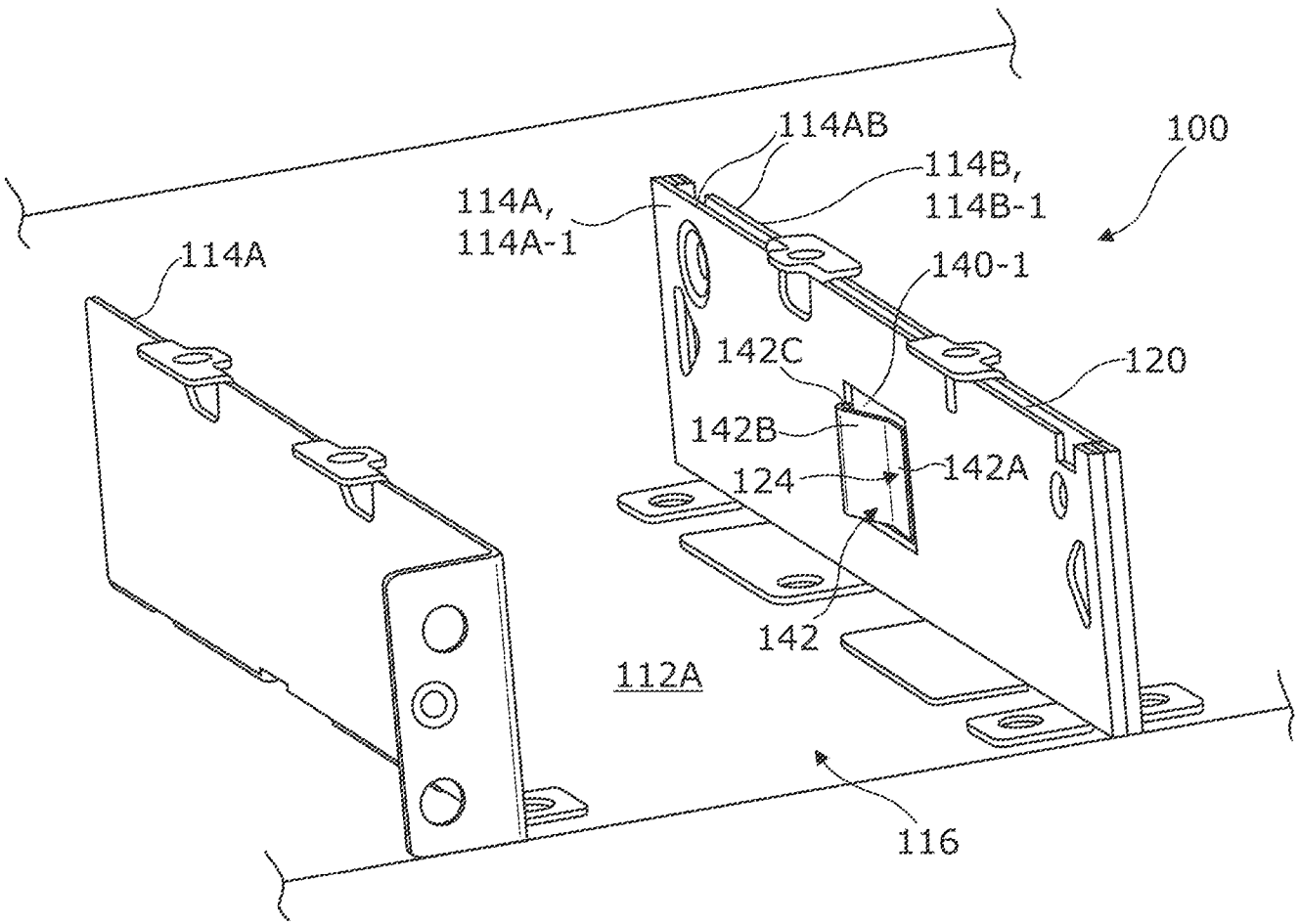
FIG. 3A illustrates a perspective view of the portion of the chassis of FIG. 1 having the insertion key assembly of FIGS. 1 and 2A-2B viewed from an adjacent passageway of the chassis according to the example implementation of the present disclosure.
Figure 3B:
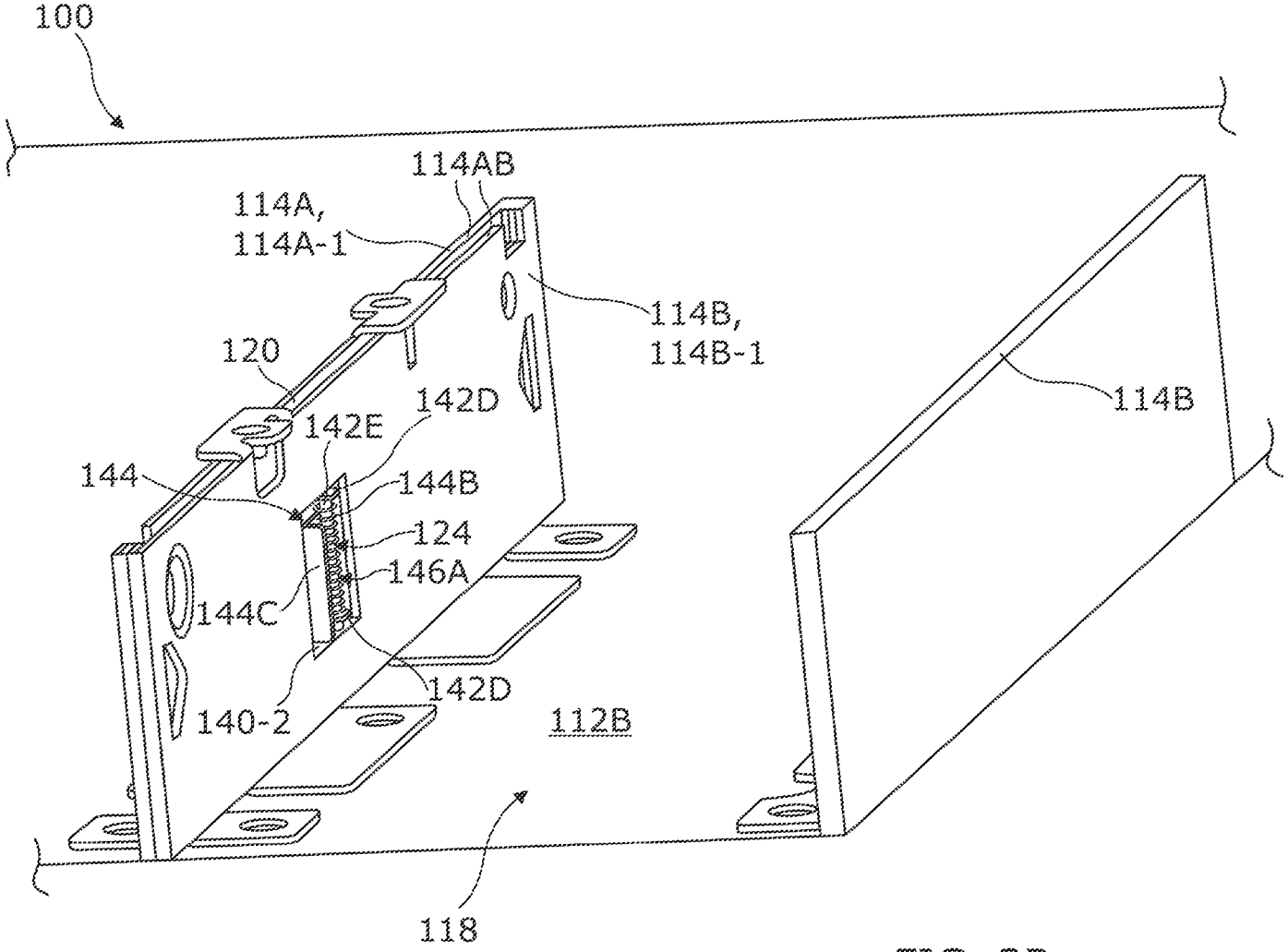
FIG. 3B illustrates a perspective view of another portion of the chassis of FIG. 1 having the insertion key assembly of FIGS. 1 and 2A-2B viewed from a passageway of the chassis according to the example implementation of the present disclosure.

In some examples, the plurality of walls 104 includes a pair of peripheral sidewalls 108, a rear panel wall 110, a front panel wall (not shown), a base wall 112, a cover wall (not shown), and a plurality of sidewalls 114. It may be noted therein that the cover wall and the front panel wall are not shown in the example of FIG. 1 for the purpose of ease of illustration, and such an illustration should not be construed as a limitation of the present disclosure. In some examples, the pair of peripheral sidewalls 108 are disposed spaced apart from each other along a lateral direction 10 of the chassis 100 and coupled to the base wall 112 and the cover wall of the chassis 100. Similarly, the rear panel wall 110 and the front panel wall are disposed spaced apart from each other along a longitudinal direction 20 of the chassis 100 and coupled to the base wall 112 and the cover wall of the chassis 100. In some examples, the plurality of sidewalls 114 are positioned within the interior space 106 of the chassis, between the pair of peripheral sidewalls 108, and coupled to the base wall 112 and the top wall of the chassis 100. For example, each sidewall of the plurality of sidewalls 114 may extend along the longitudinal direction 20 and be disposed parallel to (or spaced apart from) each other along the lateral direction 10. In such examples, a first end 114-1 of each sidewall of the plurality of sidewalls 114 may be positioned proximate to the front panel wall of the chassis 100, and a second end 114-2 of each sidewall of the plurality of sidewalls 114 may be positioned proximate to a mid-section of the chassis 100. In some examples, the plurality of sidewalls 114 includes a pair of first sidewalls 114A and a pair of second sidewalls 114B. In such examples, the pair of first sidewalls 114A, a first portion 112A of the base wall 112, and a first portion of the cover wall may collectively define an adjacent passageway 116 (or first passageway or upstream passageway or higher priority passageway) of the chassis 100. Similarly, the pair of second sidewalls 114B, a second portion 112B of the base wall 112, and a second portion of the cover wall may collectively define a passageway 118 (or second passageway or downstream passageway or lower priority passageway) of the chassis 100. In one or more examples, the adjacent passageway 116 and the passageway 118 are located mutually adjacent to each other. In some examples, a first sidewall 114A-1 (labeled in FIG. 3A) among the pair of first sidewalls 114A and a first sidewall 114B-1 (labeled in FIG. 3B) among the pair of second sidewalls 114B are positioned mutually adjacent to each other to form a pair of sidewalls 114AB. In such examples, the pair of sidewalls 114AB separates the adjacent passageway 116 and the passageway 118 from each other. In some examples, the first sidewall 114A-1 and the first sidewall 114B-1 of the pair of sidewalls 114AB are disposed spaced apart from each other to define a hollow space 120 between the pair of sidewalls 114AB. In the example of FIG. 1, the chassis 100 includes two passageways. In some examples, the chassis 100 having various numbered passageways may be envisioned without deviating from the scope of the present disclosure. In some examples, the front panel wall of the chassis 100 may include one or more cut-outs 122, for example, a first cut-out 122A, and a second cut-out 122B, where each of the first cut-out 122A and the second cut-out 122B are aligned respectively with the adjacent passageway 116 and the passageway 118 of the chassis 100 to allow pluggable modules, for example, another pluggable module 103 (as shown in FIG. 4B) and a pluggable module 102 to be removably housed (or inserted or plugged) inside the chassis 100 from an external environment.

In some examples, each of the plurality of sidewalls 114 may further include one or more locking mechanisms (not shown) to secure the pluggable modules when it is completely inserted within the adjacent passageway 116 and/or the passageway 118 of the chassis 100 without deviating from the scope of the present disclosure.

In one or more examples, the chassis 100 further includes an insertion key assembly 124 to manage priority insertion of the pluggable modules into the chassis 100. In some examples, the insertion key assembly 124 may block the insertion of a pluggable module 102 inside the passageway 118 prior to the insertion of other pluggable module 103 inside the adjacent passageway 116. In one or more examples, the insertion key assembly 124 includes one or more elements, such as a driver element, a stopper element, and a biasing element (shown clearly in FIGS. 2A-2B and 5). For example, the insertion key assembly 124 is disposed within the hollow space 120 defined between the pair of sidewalls 114AB. In some examples, the first sidewall 114A-1 of the pair of sidewalls 114AB includes a first opening 140-1 (clearly shown in FIG. 3A) to allow a portion of the insertion key assembly 124 to protrude into the adjacent passageway 116 or retract into the hollow space 120. Similarly, the second sidewall 114B of the pair of sidewalls 114AB includes a second opening 140-2 (clearly shown in FIG. 3B) to allow another portion of the insertion key assembly 124 to protrude into the passageway 118 or retract into the hollow space 120. In a relaxed state of the biasing element: i) the stopper element (shown in FIGS. 2A-2B and 3B) is pushed outwards by the biasing element so as to protrude a stopping tab of the stopper element into the passageway 118 to block an insertion of the pluggable module 102 inside the passageway 118, and ii) the driver element (shown in FIGS. 2A-2B and 3A) is pushed outwards by the biasing element so as to protrude a driving tab of the driver element into the adjacent passageway 116. Further, in the biased state of the biasing element, the stopper element is pulled inwards by the biasing element so as to retract the stopping tab from the passageway 118 to allow the unimpeded insertion of the pluggable module 102 inside the passageway 118. In one or more examples, the biasing element is moved from the relaxed state to the biased state by the driver element upon the insertion of the other pluggable module 103 inside the adjacent passageway 116. Accordingly, the insertion key assembly 124 manages the priority insertion of the pluggable modules into the chassis 100. The insertion key assembly 124 is discussed in greater detail below.

The chassis 100 may further include socket connectors, such as a first socket connector and a second socket connector (not shown) disposed at the mid-section of the chassis 100. In some examples, the first socket connector and the second socket connector may respectively face the adjacent passageway 116 and the passageway 118 of the chassis 100. In such examples, each of the first socket connector and the second socket connector may be connected to a circuit board (not shown) of the electronic system disposed on the chassis 100.

In one or more examples, the pluggable module 102 (and/or the other pluggable module 103) may be a networking device, such as a transceiver, or a storage drive, such as an NVMe storage drive, or a power supply device, or the like. It may be noted herein that some other types of pluggable module 102 and the other pluggable module 103 may be envisioned without deviating from the scope of the present disclosure. In some examples, the pluggable module 102 may include a housing section 126 and a handle section 128 coupled to a front end 130 of the housing section 126. In one or more examples, the housing section 126 may house another circuit board (not shown) of the pluggable module 102 within its interior space, and a plug connector (not shown) disposed at a rear end 132 of the housing section 126 connected to the other circuit board. In some examples, the other pluggable module 103 and the pluggable module 102 may be disposed sequentially inside the chassis 100 by way of plugging or inserting into the adjacent passageway 116 and the passageway 118 via the first cut-out 122A and the second cut-out 122B formed in the front panel wall of the chassis 100. In such examples, upon insertion of the other pluggable module 103 into the adjacent passageway 116, the other plug connector of the other pluggable module 103 may get connected to the first socket connector disposed in the chassis 100 of the electronic device so as to perform one or more functions. Similarly, upon insertion of the pluggable module 102 into the passageway 118, the plug connector of the pluggable module 102 may get connected to the second socket connector disposed in the chassis 100 of the electronic device so as to perform one or more functions. In some examples, the functions may include, but are not limited to, transceiving data, processing data, storing data, supplying power, or the like, without deviating from the scope of the present disclosure.

Figure 2B:
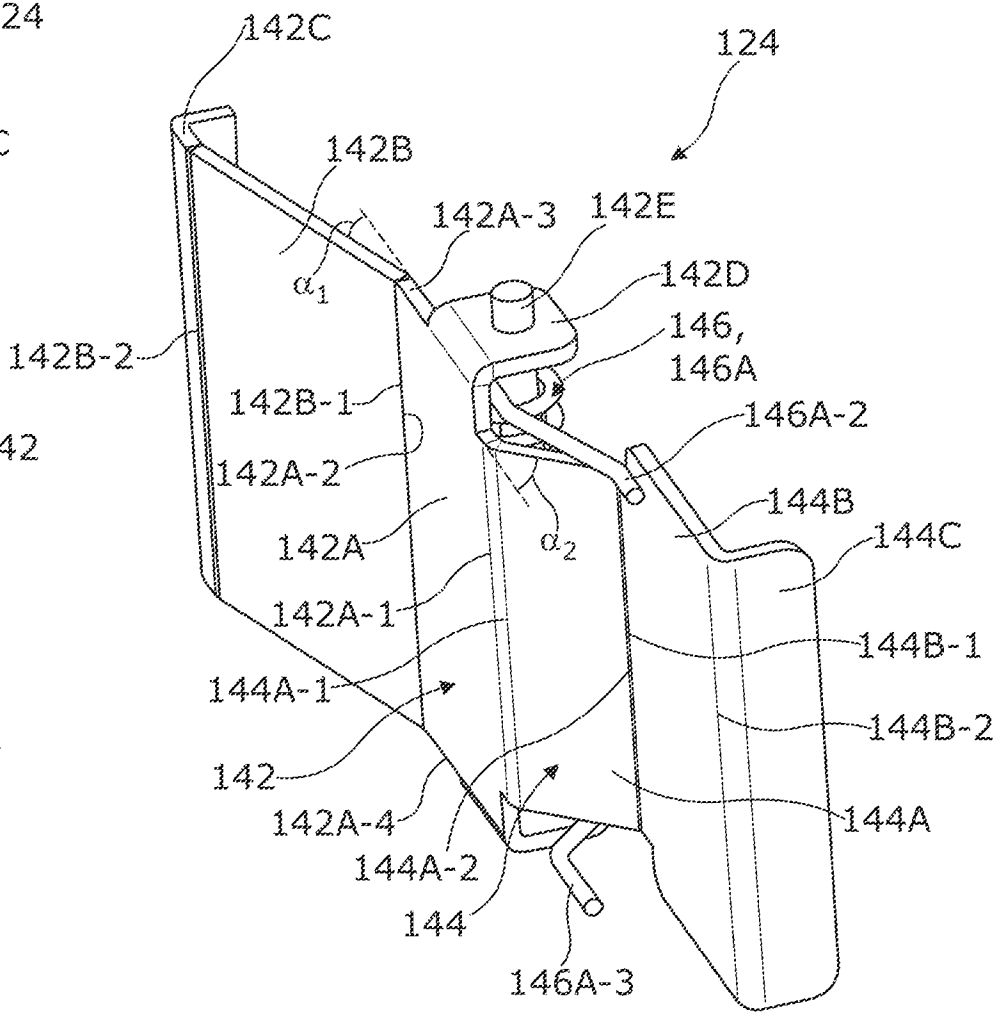
FIG. 2B illustrates a perspective back view of an insertion key assembly of FIG. 1 according to the example implementation of the present disclosure.
Figure 2A:
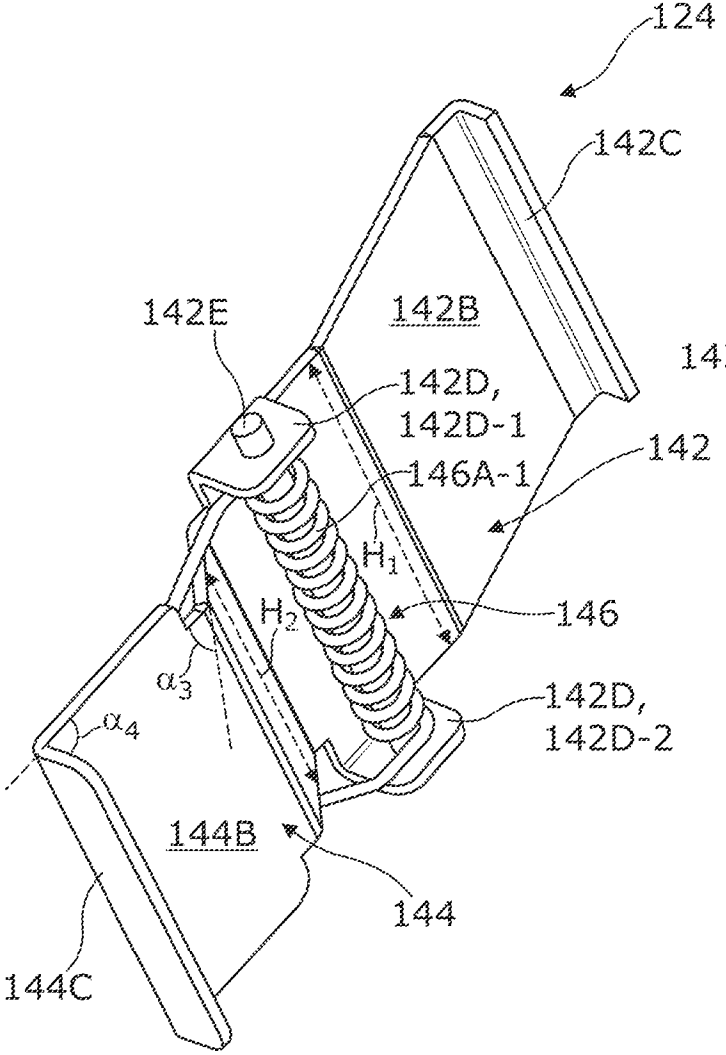
FIG. 2A illustrates a perspective front view of an insertion key assembly of FIG. 1 according to the example implementation of the present disclosure.

FIG. 2A depicts a perspective front view of the insertion key assembly 124 of FIG. 1. FIG. 2B depicts a perspective back view of the insertion key assembly 124 of FIG. 1. In the description hereinafter, FIGS. 2A and 2B are described concurrently for ease of illustration. In one or more examples, the insertion key assembly 124 includes a driver element 142, a stopper element 144, and a biasing element 146.

In some examples, the driver element 142 extends directly from the stopper element 144. In some other examples, the driver element 142 may be connected to the stopper element 144 via a suitable coupling mechanism, such as welding, or the like, without deviating from the scope of the present disclosure. In some examples, the driver element 142 and the stopper element 144 may be integrated to each other to form a unitary driver stopper element of the insertion key assembly 124.

In some examples, the driver element 142 may include a first connector tab 142A, a driving tab 142B, an end tab 142C, a pair of flanges 142D, and a rod 142E. In one or more examples, the first connector tab 142A is a rectangular-shaped tab having a first height "$H_1$". In some examples, a first vertical end portion 142A-1 of the first connector tab 142A extends from a first vertical end portion 144A-1 of the stopper element 144, and a second vertical end portion 142A-2 of the first connector tab 142A extends from a first vertical end portion 142B-1 of the driving tab 142B. A first flange 142D-1 of the pair of flanges 142D extends from a first horizontal end portion 142A-3 of the first connector tab 142A, and a second flange 142D-2 of the pair of flanges 142D extends from a second horizontal end portion 142A-4 of the first connector tab 142A. The rod 142E extends through the pair of flanges 142D and is connected (e.g., pivotably connected) to a support structure (not shown) of the pair of sidewalls 114AB (as shown in FIGS. 1 and 3A-3B). In one or more examples, the driving tab 142B is a rectangular-shaped tab. The driving tab 142B is inclined at a first angle "$\alpha_1$" relative to the first connector tab 142A. For example, the first angle "$\alpha_1$" may be around 200 degrees. Accordingly, the driving tab 142B inclined at the first angle "$\alpha_1$" may get positioned downwards relative to the first connector tab 142A due to its inclined surface relative to the first connector tab 142A. In some examples, the driving tab 142B may be pushed inwards (or moved upwards) by a compressive force generated as a result of insertion of another pluggable module 103 (as shown in FIG. 4B) inside the adjacent passageway 116. In one or more examples, the end tab 142C may be an "L" shaped tab extending from a second vertical end portion 142B-2 of the driving tab 142B. In one or more examples, the driver element 142 may function as an actuation element to trigger the biasing element 146 to switch (or move) between the relaxed state and the biased state so as to protrude the stopper element 144 into the passageway 118 or retract the stopper element 144 away from the passageway 118.

The stopper element 144 includes a second connector tab 144A, a body tab 144B, and a stopping tab 144C. In one or more examples, the second connector tab 144A is a rectangular-shaped tab having a second height "$H_2$". In some examples, the second height "$H_2$" is smaller than the first height "$H_1$". As discussed herein, the first vertical end portion 144A-1 of the second connector tab 144A extends from the first vertical end portion 142A-1 of the first connector tab 142A, whereas a second vertical end portion 144A-2 of the second connector tab 144A extends from a first vertical end portion 144B-1 of the body tab 144B. In some examples, the second connector tab 144A is a rectangular-shaped tab. The second connector tab 144A is inclined at a second angle "$\alpha_2$" relative to the first connector tab 142A. For example, the second angle "$\alpha_2$" may be around 40 degrees. Accordingly, the second connector tab 144A inclined at the second angle "$\alpha_2$" from the first connector tab 142A may aid the body tab 144B and the stopping tab 144C of the stopper element 144 to be positioned upwards relative to the first connector tab 142A of the driver element 142. In some examples, the body tab 144B interconnects the second connector tab 144A with the stopping tab 144C. For example, the first vertical end portion 144B-1 of the body tab 144B extends from the second vertical end portion 144A-2 of the second connector tab 144A. Similarly, the second vertical end portion 144B-2 of the body tab 144B extends from the stopping tab 144C. In some examples, the body tab 144B is inclined at a third angle "$\alpha_3$" relative to the second connector tab 144A. For example, the third angle "$\alpha_3$" may be around −40 degrees. Accordingly, the body tab 144B and the first connector tab 142A may get positioned parallel to one another. In one or more examples, the stopping tab 144C is inclined at an fourth angle "$\alpha_4$" relative to the body tab 144B. For example, the fourth angle "$\alpha_4$" may be around 90 degrees. Accordingly, the stopping tab 144C may be configured to protrude perpendicularly into the passageway 118 so as to block the insertion of a pluggable module 102 (as shown in FIG. 1), until the stopping tab 144C is retracted from the passageway 118 in order to allow the insertion of the pluggable module 102 into the passageway 118 of the chassis 100.

In some examples, the biasing element 146 is a torsion spring 146A. In the example of FIGS. 2A and 2B, the torsion spring 146A includes coil portions 146A-1, a first elongated end portion 146A-2, and a second elongated end portion 146A-3. In such examples, the torsion spring 146A is connected to the driver element 142 and disposed in contact with the stopper element 144. For example, the torsion spring 146-1 is disposed in between the pair of flanges 142D and around the rod 142E. In particular, the coil portions 146A-1 wrap around the rod 142E, the first elongated end portion 146A-2 contacts the body tab 144B of the stopper element 144, and the second elongated end portion 146A-3 may contact a first sidewall 114A-1 among the pair of sidewalls 114AB (as shown in FIG. 1 and FIG. 3). In some examples, the second connector tab 144A having the second height "$H_2$" smaller than the first height "$H_1$" of the first connector tab 142A may provision the first elongated end portion 146A-2 and the second elongated end portion 146A-3 of the torsion spring 146A to pass over the second connector tab 144A to contact the body tab 144B and the first sidewall 114A-1 respectively. In one or more examples, the first elongated end portion 146A-2 may push the body tab 144B, and the second elongated end portion 146A-3 may get engaged against the first sidewall 114A of the pair of sidewalls 114AB, in the relaxed state of the torsion spring 146A so as to protrude the stopping tab 144C into the passageway 118 and the driving tab 142B into the adjacent passageway 116 of the chassis 100.

FIG. 3A depicts a perspective view of the portion of the chassis 100 of FIG. 1 having the insertion key assembly 124 of FIGS. 1 and 2A-2B viewed from an adjacent passageway 116 of the chassis 100. FIG. 3B depicts a perspective view of another portion of the chassis 100 of FIG. 1 having the insertion key assembly 124 of FIGS. 1 and 2A-2B viewed from a passageway 118 of the chassis 100. In the description hereinafter, FIGS. 3A and 3B are described concurrently for ease of illustration.

In one or more examples, the insertion key assembly 124 is disposed inside the hollow space 120 formed between the pair of sidewalls 114AB of the chassis 100. For example, the biasing element 146, such as the torsion spring 146A, and a portion of the stopper element 144, and a portion of the driver element 142 are disposed within the hollow space 120. The insertion key assembly 124 is further secured to the support structure of the pair of sidewalls 114AB. Further, the rod 142E extending through the pair of flanges 142D is pivotably connected to the support structure of the pair of sidewalls 114AB. Accordingly, the first elongated end portion 146A-2 and the second elongated end portion 146-3 of the torsion spring 146A in the relaxed state may push: i) the stopper element 144 outwards so as to protrude the stopping tab 144C perpendicularly into the passageway 118 (as shown in FIG. 3B) and ii) the driver element 142 outwards so as to protrude the driving tab 142B into the adjacent passageway 116 (as shown in FIG. 3A). In one or more examples, the stopping tab 144C protruded perpendicularly into the passageway 118 blocks the insertion of a pluggable module 102 (as shown in FIG. 1) inside the passageway 118. However, the driving tab 142B protruded at an inclined angle into the adjacent passageway 116 may be pushed inwards by the insertion of another pluggable module 103 (as shown in FIG. 4B) into the adjacent passageway 116 or retracted outwards into the adjacent passageway 116 by withdrawal of the other pluggable module 103 from the adjacent passageway 116. It may be noted that the driving tab 142B retracts outwards into the adjacent passageway 116 when the passageway 118 is empty or not occupied by the pluggable module 102.

Figure 5:
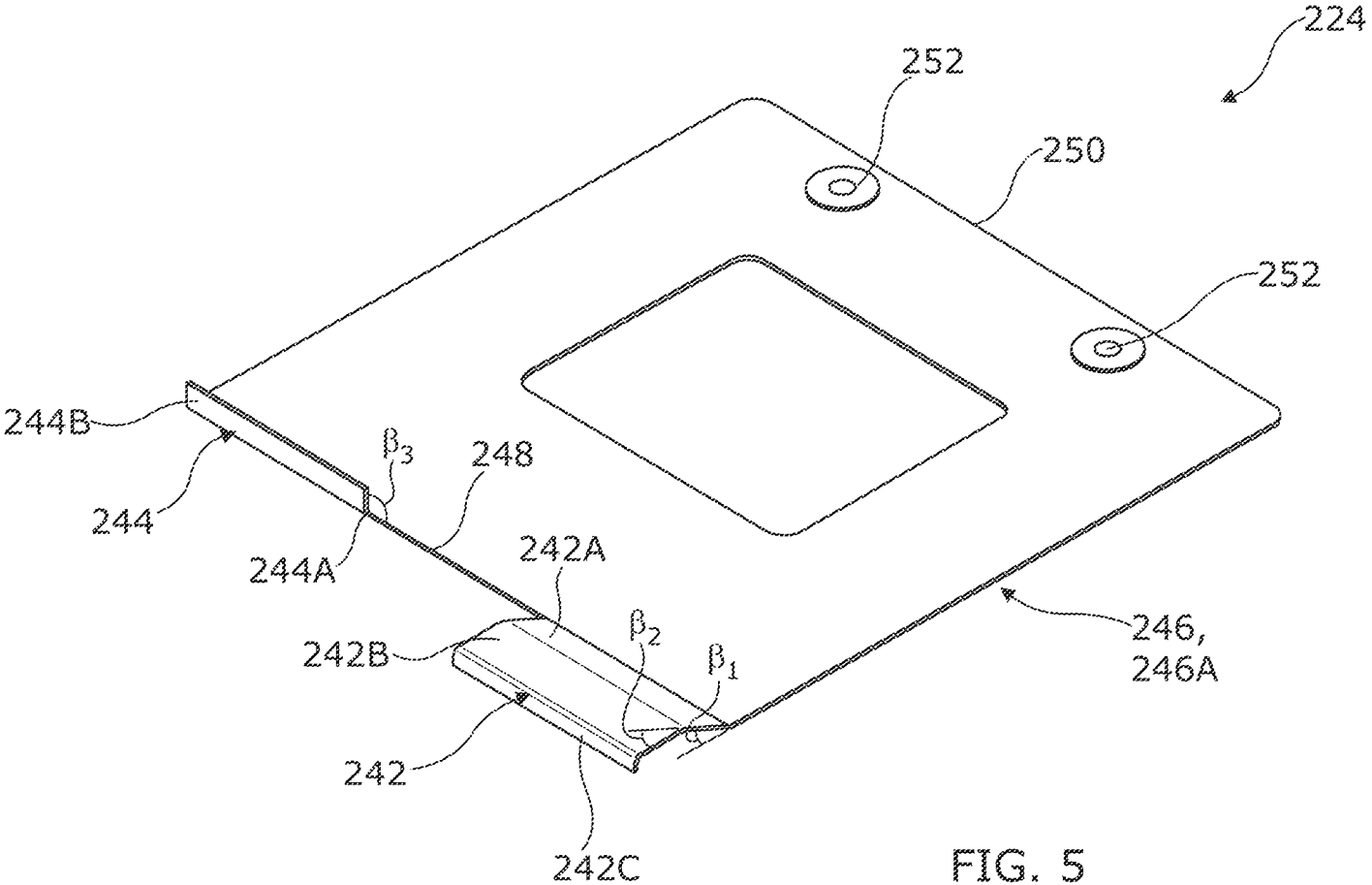
FIG. 5 illustrates a perspective view of an insertion key assembly according to another example implementation of the present disclosure.

In some examples, the chassis 100 may include an insertion key assembly 224 (as shown in FIG. 5) having a biasing element 246, such as a leaf spring 246A, a driver element 242, and a stopper element 244, disposed within a hollow space 120 formed between the pair of sidewalls 114AB, instead of the insertion key assembly 124 of FIG. 1, without deviating from the scope of the present disclosure. In some other examples, the chassis 100 may include the insertion key assembly 124 disposed within the hollow space 120 formed between the pair of sidewalls 114AB and the insertion key assembly 224 disposed on one of the base wall 112 or the cover wall of the chassis, without deviating from the scope of the present disclosure.

Figure 4A:
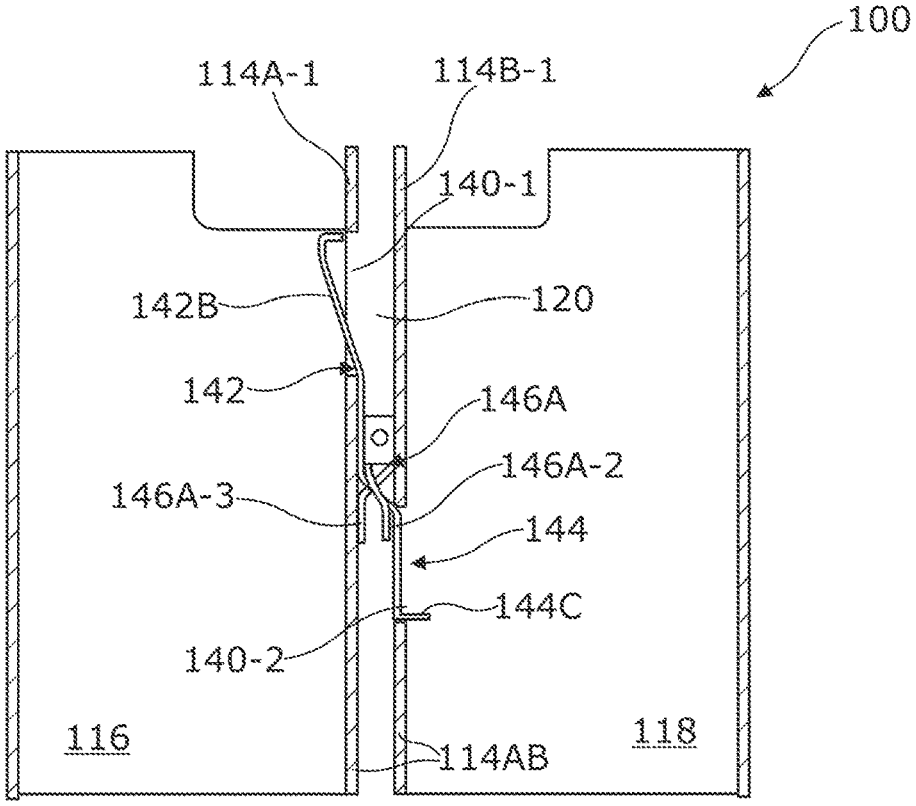
FIG. 4A illustrates a top view of a portion of a chassis having an insertion key assembly of FIGS. 1, 2A-2B, and 3A-3B in a relaxed state according to the example implementation of the present disclosure.
Figure 4B:
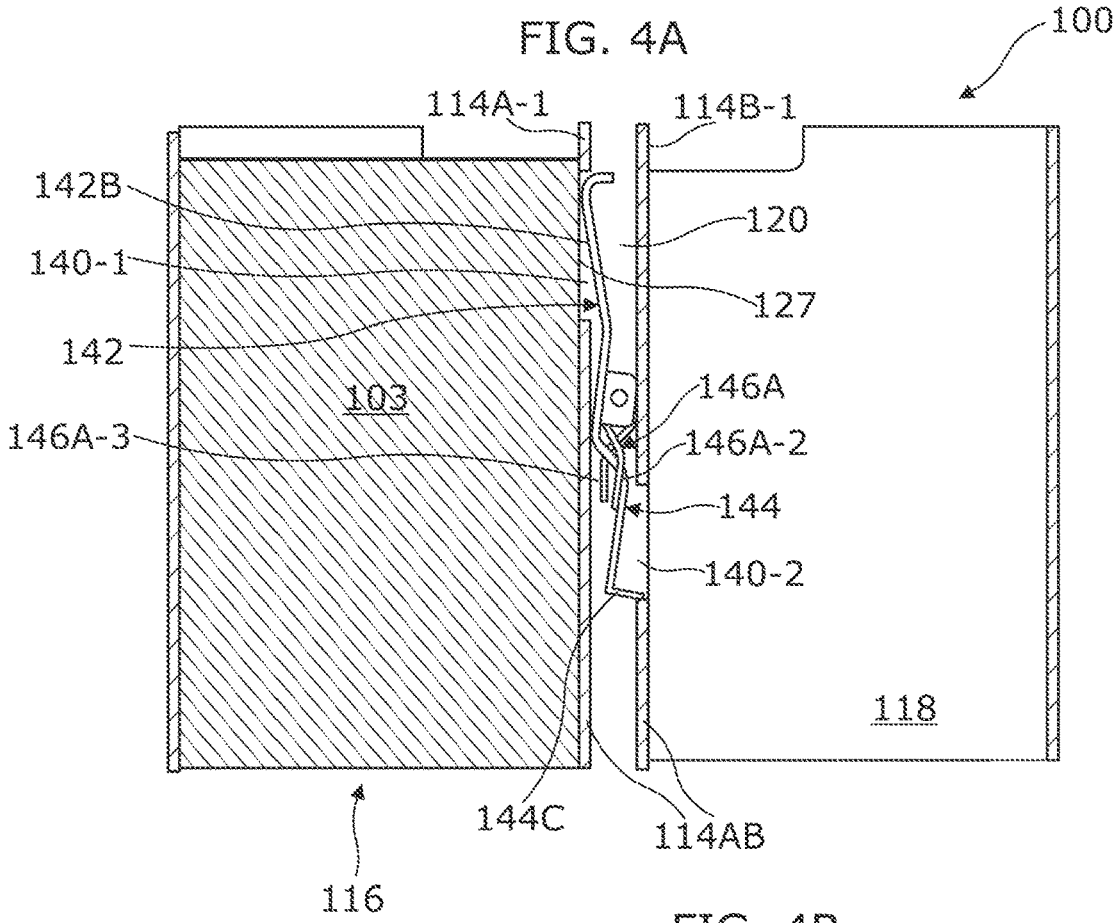
FIG. 4B illustrates a top view of a portion of a chassis having another pluggable module inserted into an adjacent passageway of a chassis and an insertion key assembly of FIGS. 1, 2A-2B, and 3A-3B in a biased state according to the example implementation of the present disclosure.

FIG. 4A depicts a top view of a portion of the chassis 100 having the insertion key assembly 124 of FIGS. 2A-2B and 3A-3B in a relaxed state. FIG. 4B depicts a top view of the portion of the chassis 100 having another pluggable module 103 inserted into an adjacent passageway 116 and the insertion key assembly 124 of FIGS. 2A-2B and 3A-3B in a biased state. In the description hereinafter, FIGS. 4A and 4B are described concurrently for ease of illustration.

Referring to FIG. 4A, upon installing the insertion key assembly 124 within the hollow space 120 defined between the pair of sidewalls 114AB, the torsion spring 146A is positioned in a relaxed state. In one or more examples, in the relaxed state of the torsion spring 146A, the driving tab 142B is protruded at an inclined angle into the adjacent passageway 116 via the first opening 140-1 formed in the first sidewall 114A-1 and the stopping tab 144C is protruded perpendicularly into the passageway 118 via the second opening 140-2 formed in the first sidewall 114B-1. In such examples, the stopping tab 144C blocks the insertion of a pluggable module 102 (as shown in FIG. 1) inside the passageway 118 prior to the insertion of another pluggable module 103 inside the adjacent passageway 116.

Referring to FIG. 4B, the driver element 142 is driven inwards by the insertion of the other pluggable module 103 inside the adjacent passageway 116. For example, upon insertion of the other pluggable module 103 inside the adjacent passageway 116, a housing section 127 of the other pluggable module 103 may apply a compressive force on the driving tab 142B so as to allow the driver element 142 to retract from the adjacent passageway 116 by moving inwards into the hollow space 120 via the first opening 140-1 formed in the first sidewall 114A-1. In one or more examples, the movement of the driver element 142 into the hollow space 120 may result in actuating the torsion spring 146A to move (or rotate) from the relaxed state to a biased state. In one or more examples, in the biased state of the torsion spring 146A, the stopper element 144 is pulled inwards by the torsion spring 146A so as to retract the stopping tab 144C from the passageway 118 to allow the insertion of the pluggable module 102 inside the passageway 118.

Further, when the other pluggable module 103 is removed from the adjacent passageway 116, the biasing element 146, for example, the torsional spring 146A moves back (or rotates back) from the biased state to the relaxed state. Thereby causing the driving tab 142B to protrude back at the inclined angle into the adjacent passageway 116 and the stopping tab 144C to protrude perpendicularly into the passageway 118 to block the insertion of the pluggable module 102 inside the passageway 118. In one or more examples, the stopping tab 144C and the driving tab 142B moves into and out of the passageway 118 and the adjacent passageway 116 respectively, via an opening 140-2, 140-1 formed in a respective sidewall 114B-1, 114A-1 of the pair of sidewalls 114AB of the chassis 100.

Hence, in one or more examples of the present disclosure the stopping tab 144C blocks the insertion of the pluggable module 102 inside the passageway 118 prior to the insertion of the other pluggable module 103 inside the adjacent passageway 116. However, upon insertion of the other pluggable module 103 inside the adjacent passageway 116, the pluggable module 102 may be inserted into the passageway 118 of the chassis.

FIG. 5 depicts a perspective view of an insertion key assembly 224 according to another example implementation of the present disclosure. In one or more examples, the insertion key assembly 224 includes a driver element 242, a stopper element 244, and a biasing element 246. In some examples, the driver element 242 is indirectly connected to the stopper element 244 via the biasing element 246.

The driver element 242 includes a first connector tab 242A, a driving tab 242B, and an end tab 242C. In one or more examples, the first connector tab 242A is a rectangular-shaped tab. In some examples, the first connector tab 242A extends from one portion of a first end 248 in the biasing element 246. Further, the first connector tab 242A is inclined at a first angle "$\beta_1$" relative to the biasing element 246. For example, the first angle "$\beta_1$" may be around 40 degrees. Accordingly, the first connector tab 242A inclined at the first angle "$\beta_1$" from the biasing element 246 may aid the driving tab 242B and the end tab 242C to be positioned upwards relative to the biasing element 246. In some examples, the driving tab 242B is a rectangular-shaped tab. The driving tab 242B is inclined at a second angle "$\beta_2$" relative to the first connector tab 242A. For example, the second angle "$\beta_2$" may be around −40 degrees. Accordingly, the driving tab 242B and the biasing member 246 may get positioned parallel to one another. In one or more examples, the end tab 242C may be an "L" shaped tab extending from a driving tab 242B.

The stopper element 244 includes a second connector tab 244A and a stopping tab 244B. In one or more examples, the second connector tab 244A is a rectangular-shaped tab. In some examples, the second connector tab 244A extends from another portion of the first end 248 in the biasing element 246. The second connector tab 244A is positioned parallel to the biasing element 246. The stopping tab 244B extends from the second connector tab 244A. In some examples, the stopping tab 244B is inclined at a third angle "$\beta_3$" relative to the second connector tab 244A (or the biasing element 246). For example, the third angle "$\beta_3$" may be around 90 degrees. Accordingly, the stopping tab 244B may be configured to protrude perpendicularly into a passageway 218 (as shown in FIG. 6A) of a chassis 200 so as to block the insertion of a pluggable module, until the stopping tab 244C is retracted from the passageway 218 in order to allow the insertion of the pluggable module into the passageway 218.

In some examples, the biasing element 246 is a leaf spring 246A. In the example of FIG. 5, the leaf spring 246A is a square-shaped element having the first end 248 and a second end 250. In some examples, the driver element 242 and the stopper element 244 are disposed spaced apart from each other, and extend from the first end 248 of the leaf spring 246A. The leaf spring 246A further includes a pair of holes 252 formed proximate to the second end 250 for connecting the leaf spring 246A to a chassis.

In one or more examples, upon application of a vertical force on the driver element 242, the driving tab 242B is pushed downwards to actuate the leaf spring 246A to move to a biased state from a relaxed state, thereby causing the leaf spring 246A and the stopping tab 244B connected to the leaf spring 246A to move downwards. Upon removal of the vertical force from the driver element 242, the leaf spring 246A moves upwards to return back to the relaxed state from the biased state, thereby causing the driving tab 242B and the stopping tab 244B connected to the leaf spring 246A to move upwards.

Figure 6A:
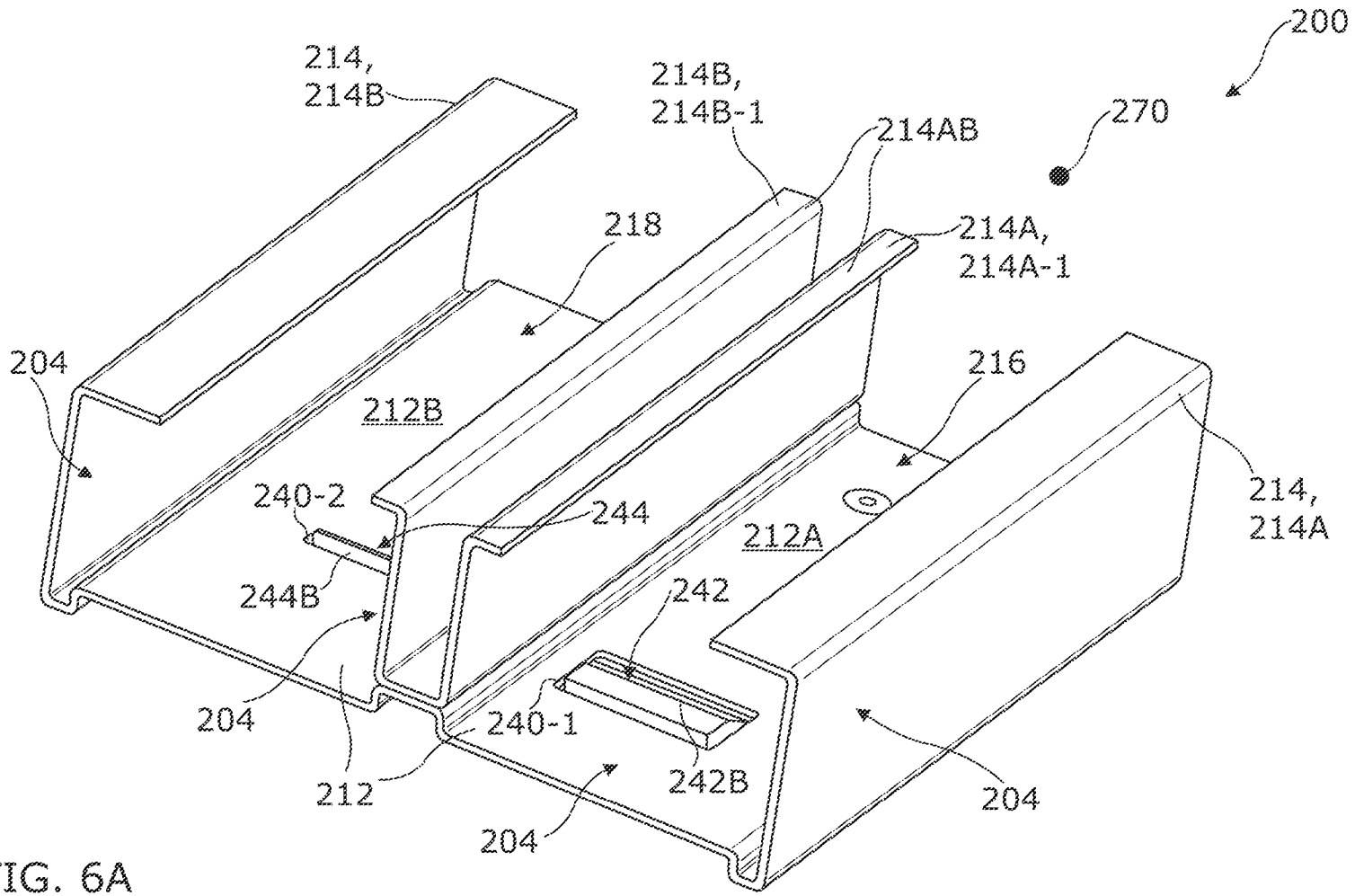
FIG. 6A illustrates a perspective top view of a portion of a chassis having the insertion key assembly of FIG. 5 in a relaxed state according to the other example implementation of the present disclosure.
Figure 6B:
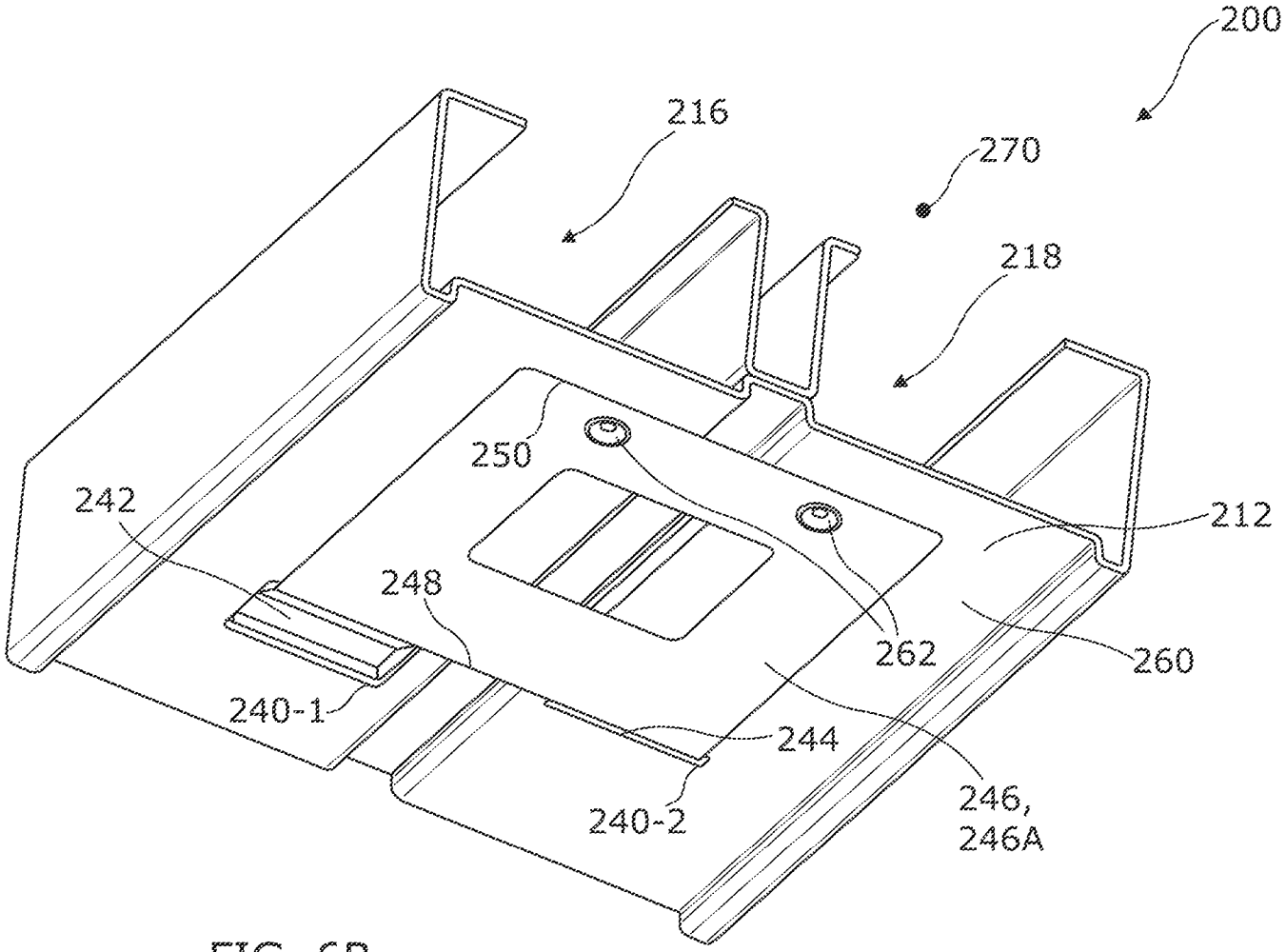
FIG. 6B illustrates a perspective bottom view of a portion of a chassis having the insertion key assembly of FIG. 5 in a relaxed state according to the other example implementation of the present disclosure.

FIG. 6A depicts a perspective top view of the portion of a chassis 200 having a plurality of walls 204 and the insertion key assembly 224 of FIG. 5. FIG. 6B depicts a perspective back view of the portion of a chassis 200 having the plurality of walls 204 and the insertion key assembly 224 of FIG. 5. In the description hereinafter, FIGS. 6A and 6B are described concurrently for ease of illustration.

The plurality of walls 204 includes a plurality of sidewalls 214 and a base wall 212. In some examples, the plurality of sidewalls 214 includes a pair of first sidewalls 214A and a pair of second sidewalls 214B. Similarly, the base wall 212 includes a first portion 212A of the base wall 212, and a second portion 212B of the base wall 212. In such examples, the pair of first sidewalls 214A and the first portion 212A of the base wall 212 may collectively define an adjacent passageway 216 (or first passageway or upstream passageway or higher priority passageway) of the chassis 200. Similarly, the pair of second sidewalls 214B, and the second portion 212B of the base wall 212 may collectively define a passageway 218 (or second passageway or downstream passageway or lower priority passageway) of the chassis 200. In some examples, the adjacent passageway 216 and the passageway 218 are located mutually adjacent to each other. In some examples, a first sidewall 214A-1 among the pair of first sidewalls 214A, and a first sidewall 214B-1 among the pair of second sidewalls 214B are positioned mutually adjacent to each other to form a pair of sidewalls 214AB. In such examples, the pair of sidewalls 214AB separates the adjacent passageway 216 and the passageway 218 from each other.

In some examples, the first portion 212A of the base wall 212 has a first opening 240-1 to allow the driving tab 242B of the insertion key assembly 224 to protrude into or retract away from the adjacent passageway 216. Similarly, the second portion 212B of the base wall 212 has a second opening 240-2 to allow the stopping tab 244B of the insertion key assembly 224 to protrude into or retract away from the passageway 218.

The biasing element 246, for example, the leaf spring 246A may be disposed on the base wall 212 or a cover wall (not shown) of the chassis 200. In the example of FIG. 6B, the biasing element 246 is shown to be disposed on a bottom surface 260 of the base wall 212. In such examples, the second end 250 of the leaf spring 246A is connected to the base wall 212 via a pair of fasteners, for example, a pair of rivets 262 extending through the pair of holes 252 formed proximate to the second end 250 of the leaf spring 246A. In other words, the leaf spring 246A may function as a cantilever beam of the insertion key assembly 224. In such examples, upon installing the insertion key assembly 224 on the base wall 212 and coupling the second end 250 of the leaf spring 246A to the base wall 212, the leaf spring 246A is held in a relaxed state. In one or more examples, in the relaxed state of the leaf spring 246A, the driving tab 242B is protruded into the adjacent passageway 116 via the first opening 240-1 formed in the first portion 212A of the base wall 212, and the stopping tab 244B is protruded into the passageway 218 via the second opening 240-2 formed in the second portion 212B of the base wall 212.

In one or more examples, the stopping tab 244B protruded perpendicularly into the passageway 218 blocks the insertion of a pluggable module 102 (as shown in FIG. 1) inside the passageway 218. However, the driving tab 242B protruded at an inclined angle into the adjacent passageway 216 may be pushed downwards by the insertion of another pluggable module 103 (as shown in FIG. 4B) into the adjacent passageway 216. In some examples, the other pluggable module 103 and the pluggable module 102 may be inserted into the adjacent passageway 216 and the passageway 218 respectively, via the front end 270 of the chassis 200. In such examples, upon insertion of other pluggable module 103 inside the adjacent passageway 216, the driver element 242 is driven downwards due to a compressive force been applied on the driving tab 242B by the other pluggable module 103. In such examples, the driving tab 242B may retract from the adjacent passageway 216 by moving downwards via the first opening 240-1 formed in the first portion 212A of the base wall 212. In one or more examples, the movement of the driver element 242 downwards may result in actuating the leaf spring 246A to move from the relaxed state to a biased state. In one or more examples, in the biased state of the leaf spring 246A, the stopper element 244 is pulled downwards by the leaf spring 246A so as to retract the stopping tab 244B from the passageway 218 to allow the insertion of the pluggable module 102 inside the passageway 218.

Further, when the other pluggable module 103 is removed from the adjacent passageway 216, the biasing element 246, for example, the leaf spring 246A moves upwards from the biased state to the relaxed state, thereby causing the driving tab 242B to protrude back at the inclined angle into the adjacent passageway 216 and the stopping tab 244B to protrude perpendicularly into the passageway 218 to block the insertion of the pluggable module 102 inside the passageway 218. In one or more examples, the stopping tab 244B and the driving tab 242B moves into and out of the passageway 218 and the adjacent passageway 216 respectively, via the second and first openings 240-2, 240-1 formed in the second portion 212B and the first portion 212A respectively, of the base wall 212 in the chassis 200.

Hence, in one or more examples of the present disclosure the stopping tab 244B blocks the insertion of the pluggable module 102 inside the passageway 218 prior to the insertion of the other pluggable module 103 inside the adjacent passageway 216. However, upon insertion of the other pluggable module 103 inside the adjacent passageway 216, the pluggable module 102 may be inserted into the passageway 218 of the chassis 200.

In some examples, the chassis 200 may include an insertion key assembly 124 of FIGS. 2A-2B having a biasing element 146, such as a torsion spring 146A, a driver element 142, and a stopper element 144 disposed on one of the base wall 212 or the cover wall, instead of the insertion key assembly 224 of FIG. 5, without deviating from the scope of the present disclosure. In some other examples, the chassis 200 may include the insertion key assembly 124 disposed within a hollow space formed between the pair of sidewalls 214AB, and the insertion key assembly 224 disposed on one of the base wall 212 or the cover wall, without deviating from the scope of the present disclosure.

Various features as illustrated in the examples described herein may be implemented in a chassis having an insertion key assembly. Accordingly, the insertion key assembly may provide significant electronic system level advantages like thermal, usability and performance optimization of pluggable modules. Further, the priority insertion key having a simple design is easy to manufacture, assemble, and cost effective. Moreover, the insertion key assembly also allow for a much more controlled field employment of the pluggable modules, and prevent inadvertent or misuse of the electronic system by the pluggable module. With the usage of the insertion key assembly in the chassis, a physical stopper element may be implemented rather than or in addition to a software-based error indicator, thereby preventing occurrence of unprecedented situations of inserting an incompatible pluggable module and/or inserting the pluggable module into lower priority passageway prior to higher priority passageway of the chassis.

In the foregoing description, numerous details are set forth to provide an understanding of the subject matter disclosed herein. However, implementation may be practiced without some or all of these details. Other implementations may include modifications, combinations, and variations from the details discussed above. It is intended that the following claims cover such modifications and variations.

What is claimed is:

1. An insertion key assembly for a pluggable module, comprising:

a stopper element comprising a stopping tab;

a biasing element connected to the stopper element; and a driver element comprising a driving tab, extending from the stopper element, or connected to the stopper element via the biasing element, wherein the biasing element, and a portion of the stopper element and the driver element are: i) disposed within a hollow space formed between a pair of sidewalls among a plurality of sidewalls of a chassis or ii) disposed on a base wall or a cover wall of the chassis, wherein, in a relaxed state of the biasing element, the stopper element is pushed outwards by the biasing element so as to protrude the stopping tab into a passageway defined by the plurality of sidewalls of the chassis to block an insertion of the pluggable module inside the passageway, and wherein, in a biased state of the biasing element, the stopper element is pulled inwards by the biasing element so as to retract the stopping tab from the passageway to allow the insertion of the pluggable module inside the passageway.

2. The insertion key assembly of claim 1, wherein, in the relaxed state of the biasing element, the driver element is pushed outwards by the biasing element so as to protrude the driving tab into an adjacent passageway defined by the plurality of sidewalls of the chassis.

3. The insertion key assembly of claim 2, wherein the biasing element is moved from the relaxed state to the biased state by the driver element, upon an insertion of another pluggable module inside the adjacent passageway.

4. The insertion key assembly of claim 3, wherein the driver element is driven inwards by the other pluggable module inserted inside the adjacent passageway, so as to retract the driving tab from the adjacent passageway and move the biasing element from the relaxed state to the biased state.

5. The insertion key assembly of claim 3, wherein the stopping tab blocks the insertion of the pluggable module inside the passageway prior to the insertion of the other pluggable module inside the adjacent passageway.

6. The insertion key assembly of claim 2, wherein the biasing element is at least one of a torsion spring or a leaf spring.

7. The insertion key assembly of claim 6, wherein the driver element further comprises a pair of flanges, and a rod extending through the pair of flanges and coupled to the chassis, wherein the biasing element is disposed in between the pair of flanges and around the rod, and wherein the biasing element comprises a first elongated end portion contacting the stopper element, and a second elongated end portion contacting a sidewall among the pair of sidewalls separating the passageway and the adjacent passageway from one another.

8. The insertion key assembly of claim 7, wherein the stopping tab and the driving tab move into and out of the passageway and the adjacent passageway respectively, via an opening formed in a respective sidewall of the pair of sidewalls of the chassis.

9. The insertion key assembly of claim 6, wherein the biasing element comprises a first end connected to the stopper element and the driver element, and a second end connected to the base wall or the cover wall.

10. The insertion key assembly of claim 9, wherein the stopping tab and the driving tab move into and out of the passageway and the adjacent passageway respectively, via a respective opening formed in the base wall corresponding to the passageway and the adjacent passageway, or the cover wall corresponding to the passageway and the adjacent passageway.

11. A chassis for removably housing a pluggable module, comprising:

a plurality of sidewalls defining a passageway and an adjacent passageway; and an insertion key assembly coupled to at least one wall of a pair of sidewalls among the plurality of sidewalls, wherein the insertion key assembly comprises:

a stopper element comprising a stopping tab;

a biasing element connected to the stopper element; and a driver element comprising a driving tab, extending from the stopper element, or connected to the stopper element via the biasing element, wherein the biasing element, and a portion of the stopper element and the driver element are: i) disposed within a hollow space formed between the pair of sidewalls or ii) disposed on a base wall or a cover wall of the chassis, wherein, in a relaxed state of the biasing element, the stopper element is pushed outwards by the biasing element so as to protrude the stopping tab into the passageway to block an insertion of the pluggable module inside the passageway, and wherein, in a biased state of the biasing element, the stopper element is pulled inwards by the biasing element so as to retract the stopping tab from the passageway to allow the insertion of the pluggable module inside the passageway for removably housing the pluggable module in the chassis.

12. The chassis of claim 11, wherein, in the relaxed state of the biasing element, the driver element is pushed outwards by the biasing element so as to protrude the driving tab into the adjacent passageway defined by the plurality of sidewalls of the chassis.

13. The chassis of claim 12, wherein the biasing element is moved from the relaxed state to the biased state by the driver element, upon an insertion of another pluggable module inside the adjacent passageway.

14. The chassis of claim 13, wherein the driver element is driven inwards by the other pluggable module inserted inside the adjacent passageway, so as to retract the driving tab from the adjacent passageway and move the biasing element from the relaxed state to the biased state.

15. The chassis of claim 13, wherein the stopping tab blocks the insertion of the pluggable module inside the passageway prior to the insertion of the other pluggable module inside the adjacent passageway.

16. The chassis of claim 12, wherein the biasing element is at least one of a torsion spring or a leaf spring.

17. The chassis of claim 16, wherein the driver element further comprises a pair of flanges, and a rod extending through the pair of flanges and coupled to the chassis, wherein the biasing element is disposed in between the pair of flanges and around the rod, and wherein the biasing element comprises a first elongated end portion contacting the stopper element, and a second elongated end portion contacting a sidewall among the pair of sidewalls separating the passageway and the adjacent passageway from one another.

18. The chassis of claim 17, wherein the stopping tab and the driving tab move into and out of the passageway and the adjacent passageway respectively, via an opening formed in a respective sidewall of the pair of sidewalls of the chassis.

19. The chassis of claim 16, wherein the biasing element comprises a first end connected to the stopper element and the driver element, and a second end connected to the base wall or the cover wall.

20. The chassis of claim 19, wherein the stopping tab and the driving tab move into and out of the passageway and the adjacent passageway respectively, via a respective opening formed in the base wall corresponding to the passageway and the adjacent passageway, or the cover wall corresponding to the passageway and the adjacent passageway.

* * * * *